US005500304A

United States Patent [19]

Löffler et al.

[11] Patent Number: 5,500,304

[45] Date of Patent: Mar. 19, 1996

[54] SILVER-NICKEL COMPOSITE MATERIAL FOR ELECTRICAL CONTACTS AND ELECTRODES

[75] Inventors: Otto Löffler, Stuttgart; Werner Niessner, Steinheim; Heinz Ambacher, Benningen; Friedrich E. Schneider, Pforzheim, all of Germany

[73] Assignees: Beru Ruprecht GmbH & Co. KG, Ludwigsburg; RAU GmbH & Co., Pforzheim, both of Germany

[21] Appl. No.: 393,040

[22] Filed: Feb. 23, 1995

Related U.S. Application Data

[63] Continuation of Ser. No. 14,990, Feb. 5, 1993, abandoned.

[30] Foreign Application Priority Data

Feb. 5, 1992 [DE] Germany ..... 42 03 250.4

[51] Int. Cl.[6] ..... C22C 1/09; C22C 1/10; C22C 5/06; H01T 13/39

[52] U.S. Cl. ..... 428/614; 313/141

[58] Field of Search ..... 428/614, 929, 428/673; 313/141; 439/887; 200/266; 420/501

[56] References Cited

U.S. PATENT DOCUMENTS

| | | | |
|---|---|---|---|
| 1,720,894 | 7/1929 | Gray | 420/501 |
| 1,970,318 | 8/1934 | Kern | 420/501 |
| 2,052,143 | 8/1936 | Kern | 420/501 |
| 2,154,068 | 4/1939 | Ellio | 420/501 |
| 3,738,920 | 6/1973 | Viglione | 420/501 |
| 4,093,887 | 6/1978 | Corbach et al. | 313/141 |
| 4,112,905 | 9/1978 | Stöckel et al. | 313/141 |
| 5,107,169 | 4/1992 | Schneider et al. | 313/141 |

FOREIGN PATENT DOCUMENTS

| | | | |
|---|---|---|---|
| 0401598 | 12/1990 | European Pat. Off. . | |
| 2250810 | 5/1974 | Germany | 428/929 |
| 2259636 | 6/1974 | Germany . | |
| 2508490 | 9/1976 | Germany . | |
| 3213481 | 10/1983 | Germany . | |
| 3918278 | 12/1990 | Germany | 313/141 |
| 61-130446 | 6/1986 | Japan | 420/501 |
| 2057498 | 4/1981 | United Kingdom | 428/670 |

OTHER PUBLICATIONS

"Silver for Chemical Equipment", The Chemical Age–Metallurgical Section, Dec. 4, 1943, pp. 557–558.

*Primary Examiner*—John Zimmerman
*Attorney, Agent, or Firm*—Sixbey, Friedman, Leedom & Ferguson; David S. Safran

[57] ABSTRACT

Silver-nickel composite for electrical contacts and electrodes, particularly intended for spark plug electrodes. In order to prevent corrosive attack to the nickel components, the silver component consists of a silver alloy which is impervious to oxygen, and the nickel component is comprised of nickel or of a nickel alloy. This facilitates the manufacture of contacts and electrodes which have a long service life.

5 Claims, 1 Drawing Sheet

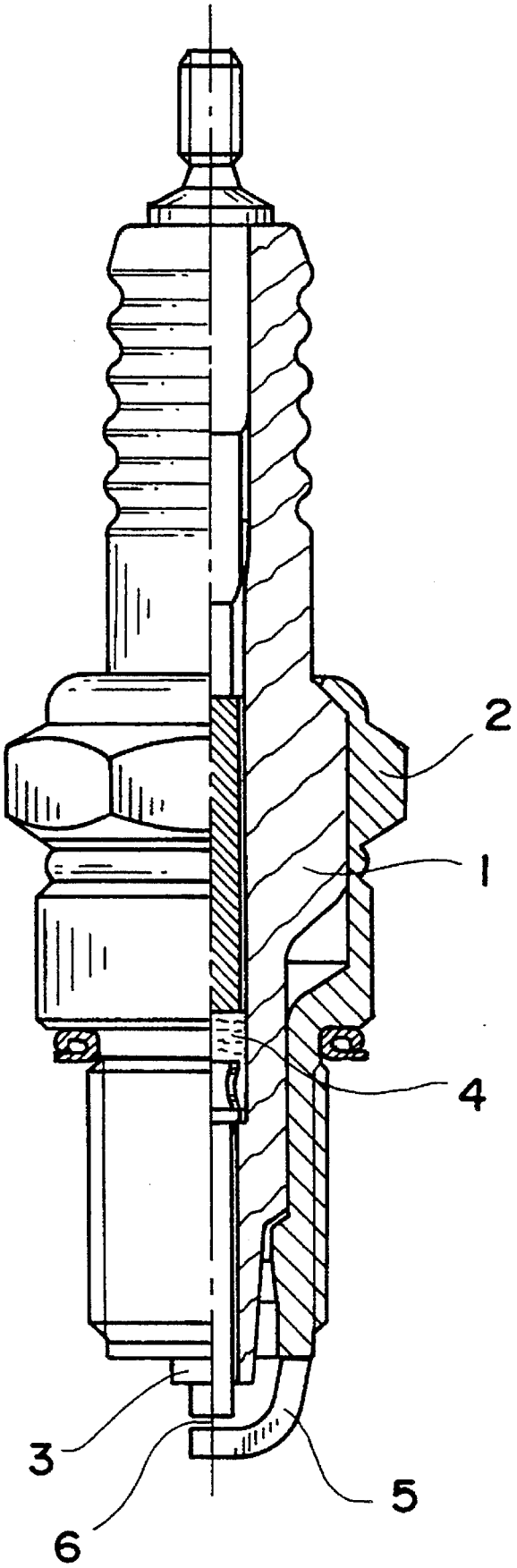
2
1
4
3
6
5

SILVER-NICKEL COMPOSITE MATERIAL FOR ELECTRICAL CONTACTS AND ELECTRODES

This application is a continuation of Ser. No. 08/014,990, filed Feb. 5, 1993, now abandoned.

BACKGROUND OF THE INVENTION

1. Field of the Invention

The present invention relates to a silver-nickel composite material for electrical contacts and electrodes, particularly for spark plug electrodes.

2. Description of Related Art

A silver-nickel composite in the form of a silver nickel fiber composite for electrodes, and a method for its manufacture, is known from German Offenlegungsschrift 25 08 490. Another German reference, German Offenlegungsschrift 022 59 636, discloses a manufacturing process for silver-nickel fiber composites.

Furthermore, German Offenlegungsschrift 32 13 481 describes a process to form a composite consisting of two helically wound silver alloy layers where, subsequent to coiling, the composite is arranged in a tube and is then extruded or drawn into wire.

When such composite materials are used for electrical contacts and electrodes, and more specifically are used for spark plug electrodes, there is the risk that the nickel components surrounded by silver components, and particularly those nickel fibers incorporated into a silver matrix, are exposed to chemical corrosion due to the fact that silver is not impervious to oxygen. This is particularly true when such silver nickel composites are used to form spark plug electrodes which are exposed to such chemical corrosion in the combustion chamber, leading in turn, to a reduction of their service life and durability.

As the space in the engine compartment of vehicles has become more limited due to an increased use of electronic components and the use of coatings for environmental protection, maintenance in the engine area has become more costly. It is, therefore, very desirable to maximize the length of time before spark plugs or spark contacts must be changed. The same rationale applies to biogas and gas engines whose spark plugs should have a long service life while undergoing a high degree of stress; an objective thus far only achieved by the use of platinum spark plugs, or electrodes which incorporate platinum metals or platinum alloys.

SUMMARY OF THE INVENTION

Accordingly, it is the primary objective of the present invention to provide a silver-nickel composite material of the kind mentioned above which facilitates a longer service life of the electrical contacts and electrodes made of such materials, and also of the components equipped with such contacts and electrodes, as for instance, spark plugs.

This objective is achieved by the concept of the present invention in that the silver components consist of a silver alloy that is impervious to oxygen.

Usage of the inventive silver-nickel composite material prevents corrosion by oxidation of the nickel components, and particularly, corrosion of the nickel fibers incorporated into a silver matrix, thereby providing a higher degree of chemical stability. Accordingly, the silver-nickel composite material of the invention is an excellent electrode material for contacts and electrodes with a long extended service life.

Additionally, when using the inventive silver-nickel composite material for spark plug electrodes, good burn-off performance is promoted so that spark plugs with electrodes of the kind described above provide an especially long service life.

In the silver-nickel composite material of the invention, the nickel component, in particular, may consist of nickel fibers having approximately 1,000 strands per $mm^2$ cross section, which are incorporated into a silver matrix. Basically, it is important to have a large number of strands per cross-sectional surface unit, which must be sufficiently thin to prevent bursting of the composite as a result of differing heat expansions.

Additionally, it is possible to alternate helically coiled silver and nickel sheets for a subsequent reduction to round wires having thin layers, so that in cross section, the silver and nickel areas alternate. Also, silver and nickel tubes can be alternatingly interfit and can be reduced to a solid composite material with thin layers. Finally, it is also possible to use nickel tubes instead of nickel fibers. The tubes are incorporated into a silver matrix and are filled with materials which promote the exit of electrons, i.e. are filled with materials which reduce the exit work function and are subsequently finished in a manner so that nickel is present as a thin strand. Such filler materials may be metal oxides or semiconducting materials. The composite material thus formed can be brought into a desired round or profiled wire form by a multiple non-cutting shaping process for use as a base material for the central or body electrodes of spark plugs.

When the central electrodes and/or the body electrodes of spark plugs are comprised of such a composite material, there is a resultant very low threshold voltage which is caused by peak effect and field displacement (silver non-magnetic, nickel magnetic), which facilitates cold starts. The uniform burn-off, across the entire surface, compared to electrodes which consist of only silver or of only nickel, and burn off at the edges, coupled with the chemical stability of the electrodes, result in a long service life of the spark plug.

The silver alloy which, in accordance with the invention, is impervious to oxygen, preferably, contains additions of silicon or tin, or additions of materials with similar properties, i.e. properties which render the silver alloy impervious to oxygen. More specifically, 0.05 to 0.3 percent of silicon by weight, and preferably, 0.3 percent silicone by weight, or more than 2 percent of tin by weight, are added.

These and further objects, features and advantages of the present invention will become apparent from the following description when taken in connection with the accompanying drawing which, for purposes of illustration only, shows use of the material in accordance with the present invention.

BRIEF DESCRIPTION OF THE DRAWING

The single figure shows a partial sectional view of a spark plug.

DETAILED DESCRIPTION OF THE PREFERRED EMBODIMENT

The spark plug depicted in the drawing, as is conventional, comprises an insulator 1, a body element 2, a central electrode 3, a glass seal 4, and a body electrode 5. Additionally, a spark gap 6 exists between the body electrode 5 and the central electrode 3.

The material for the central electrode 3 and the body electrode 5 is a silver-nickel composite, consisting, for instance, of a silver alloy matrix that is impervious to oxygen within which fibers of a nickel alloy, customary for spark plugs, are embedded. Instead, the composite material may be formed of concentric tings or helically wound sheets, consisting alternately of a silver alloy which is impervious to oxygen, and a customary nickel alloy. Electrodes consisting of the inventive silver-nickel composite may be used in combination with customary back plate electrodes, made of nickel, a nickel sheath and copper core, solid silver, platinum facing, or, may consist of a silver sheath, copper core, and separating layer.

By way of an example, the inventive silver-nickel composite may consist of 20%–80% Ni or Ni alloy and the oxygen impervious silver, with 100 to 6,000 fibers of nickel (nickel alloy) per $mm^2$. A preferred nickel alloy contains 0.3 percent by weight of Mg and 1–4 percent by weight of Si, whereby other alloys, as for instance Inconel 601 or nickel, having a chrome component, can also be used.

The oxygen impervious silver alloy in accordance with the invention, preferably, contains additions of silicon or tin, or additions of materials with similar properties, i.e. properties which render the silver alloy impervious to oxygen. More specifically, 0.05 to 0.3 percent of silicon by weight, and preferably, 0.3 percent silicone by weight, or more than 2 percent of tin by weight, are added.

The inventive silver-nickel composite material can also be used to form electrical contacts and these may consist solidly of the inventive composite material, or may be provided with welded-on plates of the inventive composite, in which case the carder material could also be copper or steel, as it is not exposed to conditions prevailing in the combustion chamber.

Instead of nickel fibers, nickel tubes filled with materials for lowering the threshold voltage can be incorporated into the silver matrix. the filler materials used are metal oxides and semiconductors, which can withstand the combustion chamber conditions. The nickel tubes are finished in a manner so that nickel is present as a thin strand. The composite material thus formed can be brought into a desired round or profiled wire form by a multiple non-cutting shaping process for use as a base material for the central or body electrodes of spark plugs.

Additionally, it is possible to alternate helically coiled silver and nickel sheets for a subsequent reduction to round wires having thin layers, so that in cross section, the silver and nickel areas alternate. Also, silver and nickel tubes can be alternatingly interfit and can be reduced to a solid composite material with thin layers.

A spark plug with a central electrode consisting of the inventive composite material was tested in continuous operation, with the result that the threshold voltage stayed nearly constant over a period of 300 hours of continuous operation (less than 10% change). Compared to other electrode materials, the minimum burn-off was more uniform over the entire spark-covered ignition surface, and the edges were considerably more stable.

The inventive silver-nickel composite material is suitable for mass production. A central electrode made of the composite material can be sealed by glass using the customary long-life, durable, resistant sealing glasses under atmospheric conditions, with the nickel fibers providing the necessary mechanical and thermal stability.

It is a benefit of the invention that the composite material is only minimally exposed to chemical corrosion, thereby imparting long service life, and that the low threshold voltage permits a wider spacing of the electrodes.

Additionally, considering possible chemical corrosion by other elements, the silver components can be supplemented by additives, like, for instance, palladium, to guard against corrosion by sulphur.

Also, the silver-nickel fiber composite material may be provided only in, or at, the customary center and/or body electrodes, at the ignition side end.

While we have described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. Silver-nickel composite material for spark plug electrodes, where silver components of the composite material consist of an oxygen impervious silver alloy and nickel components of the composite material are comprised of nickel or a nickel alloy; wherein the nickel components are formed of nickel or nickel alloy tubes filled with a material which lowers the threshold voltage, said tubes having been finished so as to result in the nickel being present in the composite as a thin fiber, 100–6,000 nickel fibers per $mm^2$ being incorporated into a matrix of the silver alloy.

2. Composite material according to claim 1, wherein the silver alloy contains silicon.

3. Composite material according to claim 2, the silver alloy comprises 0.05–0.3 percent by weight of silicon.

4. Composite material according to claim 1, wherein the silver alloy contains tin.

5. Composite material according to claim 4, wherein the silver alloy contains more than 2% by weight of tin.

* * * * *